US009702138B1

(12) United States Patent
Rutherford

(10) Patent No.: US 9,702,138 B1
(45) Date of Patent: Jul. 11, 2017

(54) MODULAR BUILDING CONSTRUCTION

(71) Applicant: Modula S., Inc., San Francisco, CA (US)

(72) Inventor: John R. Rutherford, San Francisco, CA (US)

(73) Assignee: Modula S, Inc., Ketchum, ID (US)

( * ) Notice: Subject to any disclaimer, the term of this patent is extended or adjusted under 35 U.S.C. 154(b) by 0 days.

(21) Appl. No.: 14/279,069

(22) Filed: May 15, 2014

Related U.S. Application Data

(60) Provisional application No. 61/824,938, filed on May 17, 2013, provisional application No. 61/875,508, filed on Sep. 9, 2013.

(51) Int. Cl.
*E04H 1/02* (2006.01)
*E04B 1/348* (2006.01)

(52) U.S. Cl.
CPC ..... *E04B 1/348* (2013.01)

(58) Field of Classification Search
CPC ..... E04C 1/39; E04B 2002/0213; E04B 2002/0239; E04B 2002/0204; E04B 1/34861; E04B 1/3483; E04H 1/1205; E04H 1/1005; Y02B 10/40
See application file for complete search history.

(56) References Cited

U.S. PATENT DOCUMENTS 903,906 A * 11/1908 Soss ..... 52/592.6
2,271,030 A * 1/1942 Palanti ..... 52/591.4
2,746,892 A * 5/1956 Elfving ..... 428/186
3,703,058 A 11/1972 Klett et al.
3,785,096 A 1/1974 Neuhardt
4,054,246 A * 10/1977 Johnson ..... 126/620
4,068,423 A * 1/1978 Marsh ..... A01G 9/16 135/118
4,101,255 A * 7/1978 Fernaeus et al. ..... 425/219
4,646,495 A * 3/1987 Chalik ..... E04B 1/04 52/236.3
4,854,094 A * 8/1989 Clark ..... 52/79.1
6,000,183 A * 12/1999 Newman ..... 52/311.1
6,053,661 A * 4/2000 Lewis ..... 405/36
6,598,363 B1 * 7/2003 Ferguson ..... E04B 1/34315 52/270

(Continued)

FOREIGN PATENT DOCUMENTS

DE 2435735 A1 * 2/1976 ..... E01C 5/00
DE 9414542 * 11/1994 ..... E02D 29/02

(Continued)

*Primary Examiner* — Christine T Cajilig
(74) *Attorney, Agent, or Firm* — Wilson, Sonsini, Goodrich & Rosati

(57) ABSTRACT

The present disclosure provides building structures. A building structure can comprise a plurality of modules. An individual module among the plurality can comprises a plurality of wall panels. One or more wall panels of the plurality of wall panels can comprise undulating outer surfaces that each conform to an undulating outer surface of an adjacent module. The building structure can further comprise a binding agent in one or more void spaces between the plurality of modules. The binding agent is configured to maintain the plurality of modules in proximity to one another. The building structure may contain components to increase the energy efficiency of the structure.

20 Claims, 10 Drawing Sheets

(56) References Cited

U.S. PATENT DOCUMENTS

| | | | | |
|---|---|---|---|---|
| 8,484,929 | B1 * | 7/2013 | Begdouri | 52/745.03 |
| 2005/0193643 | A1 * | 9/2005 | Pettus | B01L 99/00 52/79.1 |
| 2007/0056304 | A1 * | 3/2007 | Everett et al. | 62/260 |
| 2007/0271857 | A1 * | 11/2007 | Heather et al. | 52/79.9 |
| 2008/0134589 | A1 * | 6/2008 | Abrams et al. | 52/79.1 |
| 2009/0260776 | A1 * | 10/2009 | Calamaro | 165/45 |
| 2010/0236594 | A1 * | 9/2010 | Hammann | 135/143 |
| 2011/0056147 | A1 * | 3/2011 | Beaudet | 52/79.9 |
| 2011/0162293 | A1 * | 7/2011 | Levy et al. | 52/79.9 |
| 2011/0173907 | A1 * | 7/2011 | Katsalidis | 52/236.3 |
| 2011/0289860 | A1 * | 12/2011 | Wilson | 52/79.5 |
| 2012/0125019 | A1 * | 5/2012 | Sami | 62/79 |
| 2013/0305642 | A1 * | 11/2013 | Propst | E04D 1/28 52/309.3 |
| 2014/0007528 | A1 * | 1/2014 | Keller | H02J 7/355 52/173.3 |
| 2014/0223840 | A1 * | 8/2014 | Wheeler | 52/79.9 |
| 2014/0298745 | A1 * | 10/2014 | Rechenmacher et al. | 52/425 |

FOREIGN PATENT DOCUMENTS

| | | | | |
|---|---|---|---|---|
| DE | 9414542 | U1 * | 11/1994 | E02D 29/025 |
| EP | 2146150 | A2 * | 1/2010 | F24F 5/00 |
| WO | WO 2005078212 | A1 * | 8/2005 | E04H 1/12 |
| WO | WO 2010022406 | A1 * | 2/2010 | G21F 3/00 |

* cited by examiner

MODULAR BUILDING CONSTRUCTION

CROSS-REFERENCE

This application claims priority to U.S. Provisional Patent Application Ser. No. 61/824,938, filed May 17, 2013, and U.S. Provisional Patent Application Ser. No. 61/875,508, filed Sep. 9, 2013, each of which is entirely incorporated herein by reference.

BACKGROUND

Modular buildings are sectional, prefabricated buildings that have multiple sections, called "modules." "Modular" may be a method of construction. The modules can be six sided boxes constructed in a remote facility, then delivered to their intended site of use. Using a crane, the modules can be set onto the building's foundation. The modules can be placed side-by-side, end-to-end, or stacked up to 6 stories in height, allowing a wide variety of configurations and styles in the building layout.

Modular buildings may not have axles or a frame. They may be transported to their site using flat-bed trucks, for example. Modular buildings may be required to conform to local and federal building codes for their proposed use.

SUMMARY

Although there are modular buildings currently available, recognized herein are various limitations associated with such buildings. There are a number of solutions for prefabricated wall and modular building construction. Some of these solutions attempt to build light gauge steel stud modules, but these solutions fail to meet the needs of the construction industry because of inefficiencies in structural capacity and fireproofing. This may lead to solutions where they attempt to add complex structural and fireproofing systems, which may then lead to increased costs. These solutions may ignore the benefits of integrating structural and fireproofing capacity within a lightweight wall assembly which may be suitable for repetitive modular construction elements. Therefore, there currently exists a need in the industry for devices, assemblies and associated methods that results in affordable superior quality buildings.

As recognized herein, it may be desirable to have a wall and modular construction system that enables the construction of commercial mid-rise, 3 to 30 story buildings in a fireproof and cost effective manner. Furthermore, it may also be desirable to have a modular construction system that is repetitive, faster to erect, fireproof, lighter, stronger and is installed with less labor. Still further, it may be desirable to have devices and assemblies that are of lower cost and higher performance.

The present disclosure provides systems and methods that advantageously provide solutions to the aforementioned deficiencies by providing a reinforced wall system which when implemented as a pre-fabricated modular building system creates buildings of higher quality at lower costs.

The present disclosure provides devices, systems, and methods that generally relate to a structurally and thermally efficient wall and modular block design which can be advantageous for modular building implementation.

A building system of the present disclosure includes a wall and modular block for building construction, which can be comprised of the following components: walls, modular blocks, tensile surfaces, and poured concrete glue. The wall members can have undulating parallel tensile surfaces on both sides with compressive concrete glue filling the void that is formed. The modular blocks can be repetitive wall components patterned into three dimensional building blocks and can be arranged to create consistent or substantially consistent voids between one another. The modular blocks in some cases are specifically patterned to create an interlocking structure. The modular blocks can be connected as follows: they are stacked geometrically upon one another to form a cellular structure, and concrete glue is then poured filling the voids between the modules. The resulting structure is a complete modular building system for large fireproof commercial buildings.

Systems of the present disclosure may also have one or more of the following: 1) the modules may be made with any tensile material as its surface, 2) the wall and/or insulated wall may be used as an independent device in standard construction buildings, 3) the modular blocks may be self-erecting, 4) The modular blocks may have connecting and joining cut-outs from one block to another, 5) the modular blocks can have a beam space at the floor and wall intersection, which space can be suitable for standard concrete reinforcement, and 6) the entire structure may poured and glued after all modules are placed.

In some embodiments, a module building is constructed by forming individual modules by erecting sides, at least some of which can have undulating surfaces. The sides can be formed and placed in a side-by-side fashion, in some cases stacked on top of one another. A binding agent (e.g., concrete) can then be poured The present disclosure provides: (1) The pouring of high flow concrete as the last step in the process and using the concrete as a glue; (2) The elimination of standard reinforcing, rebar, in the creation of a reinforced structural wall; (3) Prefabricated modules remain lightweight through erection & assembly as the concrete is added after assembly; (4) The pre-fabricated modular block unit is a multi-use component, shipping container, tensile structural reinforcing and concrete form; (5) The undulating exterior insulated wall panel is designed with air voids and layers of insulation surrounded with dead airspaces; (6) The undulation of the wall assembly with the tensile element on the outside surface and with that surface traveling into the center, neutral plane, of the wall and (7) The creation of a repetitive interlocking modular block geometry that creates a uniform voids between modules with the geometry remaining the same from one modular block to the next.

A building module of the present disclosure has various features and advantages such as: (1) its undulating and repetitive wall geometry; (2) Tensile materials located on the exterior of the wall; (3) Due to the undulations the tensile material spans from the neutral axis of the wall to the maximum compression and/or tension area of stress; (4) The use of concrete as a glue in a wall assembly; (5) The modular blocks are multi-use; shipping, structural and formwork; (6) The repetitive interlocking pattern of the modular blocks; and (7) The ability of high flow concrete to flow completely around the modular blocks. The current disclosure provides methods for: (1) Creating modular building blocks with a continuous tensile sheet as an exterior enclosure; (2) Quickly erecting modular blocks in a loose fit configuration, i.e., there are voids between the blocks;

1. After erection high flow concrete can be poured as a glue between the blocks and
2. The completed blocks become a composite structural building.

In an aspect, a building structure comprises a plurality of modules, wherein an individual module among the plurality comprises a plurality of wall panels, wherein one or more wall panels of the plurality of wall panels comprise undulating outer surfaces that each conform to an undulating outer surface of an adjacent module; and a binding agent in one or more void spaces between the plurality of modules, wherein the binding agent is configured to maintain the plurality of modules in proximity to one another. In an embodiment, the modules do not contact each other. In another embodiment, at least a subset of the wall panels comprises one or more electronic components. In another embodiment, the electronic components are dedicated for use with a given module among the plurality of modules. In another embodiment, at least a subset of the wall panels comprises one or more photovoltaic cells. In another embodiment, at least a subset of the wall panels comprises an energy storage system. In another embodiment, at least a subset of the wall panels comprises a heat exchanger. In another embodiment, the heat exchanger is configured to exchange thermal energy between an interior of the given module and an environment external to the given module. In another embodiment, at least a subset of the plurality of modules is configured to communicate with one another through a communications bus. In another embodiment, at least a subset of the wall panels includes snap-on panels. In another embodiment, a subset of the wall panels comprises thermal insulation. In another embodiment, at least a subset of the plurality of modules comprises a heating and/or cooling system. In another embodiment, at least a subset of the wall panels is formed of a material comprising a composite material. In another embodiment, at least a subset of the wall panels is formed of a material comprising carbon. In another embodiment, at least a subset of the wall panels is formed of a material comprising a polymeric material. In another embodiment, at least a subset of the wall panels is configured to radiate thermal energy. In another embodiment, at least a subset of the wall panels is fireproof. In another embodiment, the plurality of modules is arranged in a side-by-side configuration, stacked configuration, or a combination thereof.

In another aspect, a method for forming a building structure comprises positioning a first building module adjacent to a second building module, wherein a first undulating outer surface of a wall panel of the first building module conforms to a second undulating outer surface of a wall panel of the second building module; and providing a binding agent in a void space between the first and second undulating outer surfaces.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "figure" and "FIG." herein), of which:

FIG. 9*b* is an exploded view of the module of FIG. 9*a*.

FIG. 10*b* is a detailed view of the ground structure of FIG. 10*a*.

DETAILED DESCRIPTION

Figure 1A:
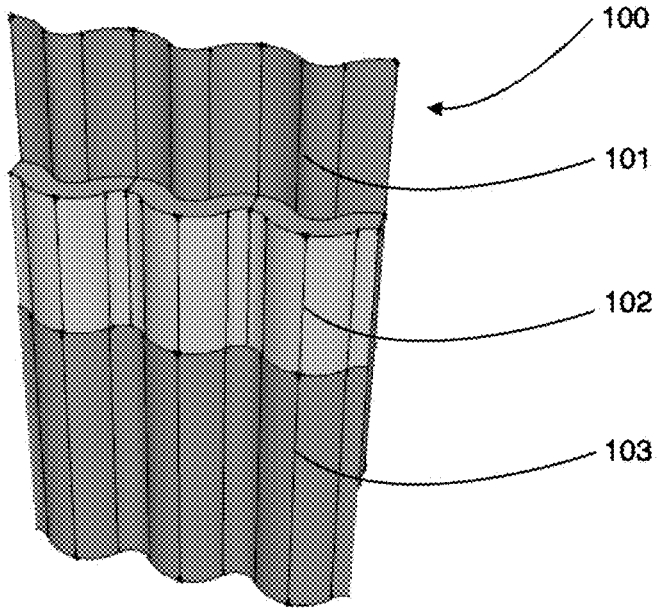
FIG. 1*a* is a perspective front view of the complete ribbon wall assembly, in accordance with some embodiments of the present disclosure.

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

The present disclosure provides modular building systems and processes. Modular buildings of the present disclosure can comprise wall assemblies. The modular buildings may be used for the construction of modular ships, shipping boxes, human residences, or other building structures. Individual wall panels may be used as structural walls. Wall assemblies of the present disclosure can be used as building floors, walls and roof panels. In some embodiments, a wall assembly has superior structural capacity due to its undulating form and tensile material on the exterior surface. The wall assembly can be assembled as patterned modular blocks, which can be readily and quickly erected on building sites and then bound together with a binding agent (e.g., concrete, epoxy) or, as an alternative, a mechanical fastening member (e.g., screws). The wall assembly can be used to build buildings faster and at a lower cost. The wall assembly can include an exterior wall panel with superior insulating capacity due to the creation of insulating airspaces due to the undulations. Wall assemblies of the present disclosure can enable the formation of a building in a time period that is less than or equal to about 12 hours, 6 hours, 3 hours, 2 hours, 1 hour, 30 minutes, 10 minutes, 4 minutes, 4 minutes, 3 minutes, 2 minutes, 1 minute, or 30 seconds.

In some examples, the wall assembly can include an undulating structural steel sheet, high flow self-compacting concrete, modular blocks and modular members which can be configured as follows: structural steel sheet undulates in geometric patterns, the sheet can be assembled into modular blocks, the modular blocks can be erected and concrete can be poured to glue the assembly modules into a structure. In addition, insulated exterior panels can be erected and bound (e.g., glued) to the modules.

In some examples, modular blocks are erected, aligned and in the final step a binding agent (e.g., concrete glue, epoxy) is poured in the voids between the blocks. At the conclusion of these operations, the wall assembly can be a complete or substantially complete structural building that may comply with structural requirements (e.g., those requirements pertaining to earthquakes or blast protection), fireproofing and thermal performance. The combination of the wall undulation and the binding agent may make the building structure more tolerant to installation errors. Misalignment of the wall sheets may result in a building that does not meet necessary structural requirements, which may make it necessary to employ meticulous installation procedures. Methods and systems of the present disclosure can remove the need for meticulous installation, which may result in lower building costs and faster set up times.

In an aspect, a building structure comprises a plurality of modules. An individual module among the plurality comprises a plurality of wall panels. One or more wall panels of the plurality of wall panels comprise undulating outer surfaces that each conform to an undulating outer surface of an adjacent module. Wall panels may be constructed from composite material, a carbon-based material (e.g., carbon fiber), a metallic material (e.g., steel or aluminum), a polymeric material, or a combination thereof. The geometric pattern on the wall may be undulating or it may be an alternative geometric pattern that is able to mate with an adjacent panel. The undulating pattern can be at least partially or substantially periodic. The building structure can further comprise a binding agent in one or more void spaces between the plurality of modules. The binding agent may be concrete, epoxy, cement, or plaster. The binding agent is configured to maintain the plurality of modules in proximity to one another. In some cases, the modules do not contact each other.

At least a subset of the wall panels can comprise one or more electronic components. The electronic components can be dedicated for use with a given module among the plurality of modules, or dedicated for use with the building structure in its entirety. The panels can include active integrated technologies.

In some cases, at least a subset of the wall panels comprises one or more photovoltaic (PV) cells. For instance, a given wall panel can include a PV module comprising a plurality of PV cells. The PV cells can be silicon-based cells or Group III-V based cells, for example. The PV modules and/or PV cells can be situated along a direction that is optimized to come in contact with electromagnetic energy (e.g., sunlight).

At least a subset of the wall panels can comprise an energy storage system. An energy storage system can be a battery (e.g., solid state battery), capacitor, or a fuel cell. The energy stored in the storage system can be collected or harvested from the PV modules or geothermal modules. The energy collected or harvested can be used directly as thermal energy or converted to electrical, kinetic, or chemical energy. The modules can each or collectively include a control system for regulating use of energy stored in the energy storage system. The control system can be in communication with the PV and geothermal modules. In an example, the control system can be used to utilize geothermal energy when electromagnetic energy is not available.

At least a subset of the wall panels can comprise a heat exchanger. A heat exchanger can be in a chamber or other storage compartment of a given panel. The heat exchanger can be configured and adapted to exchange thermal energy between an interior of the given module and an environment external to the given module. In an example, the heat exchanger comprises one or more sets of tubing for capturing geothermal energy. The tubing can be made of copper, high-density polyethylene, or other high thermal conductivity material known in the art. The geothermal energy may be ground source geothermal energy. The wall panel may be super-insulated. Examples of materials for super-insulation include fiberglass, cellulose, polystyrene, polyurethane foam, mineral wool, or dead air space (e.g., air space between 0.5 inches to 2 inches). The heat exchanger can include a fluid flow system (e.g., pump with fluid flow tubes) for circulating a working fluid to capture thermal energy. The other working fluid in the heat exchanger can be water, water mixed with propylene glycol, or refrigerant. The heat exchanger may be placed in soil with enhanced heat transfer characteristics such as increased moisture.

Wall panels may be interchangeable. Wall panels may be super-insulated. For instance, exchanging a wall panel with components of a first functionality with a wall panel with components of a second functionality can impart the second functionality to a module having the second panel.

In some cases, at least a subset of the plurality of modules is configured to communicate with one another. In some cases, the subset communicates with one another wirelessly. As an alternative, the subset is in electrical communication with one another through a communications bus (e.g., copper-based communications bus).

Modules can be brought in communication with one another by virtue of the modules being adjacent to one another. In some cases, the modules can include electronics that are configured to sense automatically or manually (e.g., on a user's request) adjacent modules, and upon recognizing adjacent modules, form a network or grid comprising the modules.

In some situations, at least some of the wall panels are snap-on panels. For example, the wall panels can include mechanical fastening members that permit a first module to snap onto a second module that is adjacent to the first module.

At least a subset of the wall panels can comprise thermal insulation. In an example, at least a subset of the wall panels comprise fiberglass. In some cases dead air space may serve as the insulating agent.

At least some of the wall panels can comprise a heating and/or cooling system. For instance, a wall panel can include an air conditioning and/or heating system for cooling and/or heating a module or the building structure.

The modules can be in fluid communication with one another. In some examples, the modules are in fluid communication with one another through fluid passageways between the modules (e.g., air ducts).

Wall panels can be formed of various types of materials. At least some of the wall panels can be formed of a composite material, a carbon-based material (e.g., carbon fiber), a metallic material (e.g., steel, aluminum), a polymeric material, or a combination thereof.

At least a subset of the wall panels can be configured to radiate or reflect electromagnetic energy and/or thermal energy. As an alternative, or in addition to, at least a subset of the panels can be configured to absorb electromagnetic radiation. The absorbed radiation can be converted to thermal, chemical, or kinetic energy for use in the module or modular building structure.

At least some of the panels can be fireproof. In some embodiments, the panels can be formed of a material that is resistant to combustion. Such set up can be steel panels with a concrete binder. The embodiment is fireproof due to the low flammability and weak thermal conductivity of concrete and the low flammability of steel.

Modules and wall panels of the modules can be configured to secure against external and/or internal forces, such as explosions. In some cases, wall panels are formed of a material (e.g., carbon fiber, reinforced carbon fiber) for blast protection.

Panels can have various shapes, sizes and configurations. Panels can have shapes that are circular, triangular, square, rectangular, pentagonal, hexagonal, heptagonal, octagonal, or partial shapes or combinations thereof. Panels can be fastened together with chemical (e.g., adhesive) and/or mechanical fastening members. Mechanical fastening members include snap-on fastening.

A module can include any number of panels. In some cases, a module includes at least 1, 2, 3, 4, 5, 6, 7, 8, 9, 10, 20, 30, 40, 50, 60, 70, 80, 90, or 100 panels (see, e.g., FIG. 5*a* for an individual module). A building structure can include any number of modules. In some cases, a building structure includes at least 1, 2, 3, 4, 5, 6, 7, 8, 9, 10, 20, 30, 40, 50, 60, 70, 80, 90, or 100 modules.

A module can be hollow. As an alternative, a module can include a core structural support member, such as, for example, a core support member formed of an organic material (e.g., wood), metallic material (e.g., steel), or combination thereof. In an example, a module includes a core formed of steel.

In some embodiments, a modular building comprises a plurality of building modules. Each module can comprises a plurality of walls with surfaces that undulate in a wave-like fashion. A surface of a wall of a first module is configured to rest adjacent or in proximity to a surface of a wall of a second module. The walls can contain electronics or electrical components dedicated for an individual building module or for the modular building.

The building modules can be mounted to rest adjacent to one another. In some examples, the building modules are horizontally adjacent. As an alternative, or in addition to, the building modules can be vertically adjacent to one another, such as in a stacked fashion. For instance, the modules can be in a side-by-side configuration, stacked configuration, or a combination thereof (i.e., some modules are side by side, while others are stacked on top of one another).

In some situations, adjacent modules do not touch one another. A void space between undulating surfaces of the modules is configured to accept a binding agent (e.g., concrete). In cases in which modules are stacked, one or more spacers can be used to separate the modules from one another.

In some examples, a modular building comprises the following components: walls, floors, prefabricated modules and concrete glue infill. These members are arranged into pre-fabricated modules. These modules are then arranged into three dimensional structures which can take the form of a building or any other structure. The modules can be unitized to resolve structural forces within themselves or external forces, and as a component of the larger structural building assembly. The stacking of modules can form a complete structural wall and floor system. After stacking, the modules can be glued together with a binding agent, for example, concrete. The addition of the concrete completes the creation of the structural members as composite structural and fireproof elements. In some cases, the main structural materials are steel and concrete, but other structural materials may be used in their place. Additionally, the binding agent (e.g., concrete) can be of the self-compacting high flow mix type, which can flow into all of the created voids. Also, an integral exterior panel can be applied to create an insulated envelope. In some cases, the modules are factory pre-fabricated, are stacked on-site, and the concrete is poured to create a reinforced structure.

Modules can be bound or glued together using a binding agent. In some examples, the binding agent is a composite material, such as concrete, which can comprises coarse granular material (the aggregate or filler) embedded in a hard matrix of material (the cement or binder) that fills the space among the aggregate particles and glues them together.

Reference will now be made to the figures, wherein like numerals refer to like parts throughout. It will be appreciated that the figures and features therein are not necessarily drawn to scale.

FIG. 1*a* shows a ribbon wall (100) that is comprised of an outer continuous tensile sheet undulates as a wall surface (101) which is a rigid structural shape with undulations that may be spaced by at least about 1 inch, 2 inches, 3 inches, 4 inches 5 inches, 1 foot, 2 feet, or 5 feet apart. The undulations may be spaced evenly or unevenly. The undulations may be spaced periodically, semi-periodically, or not periodically. The depth of the undulations may be at least about 1 inch, 2 inches, 3 inches, 5 inches, 6 inches, 12 inches, or 18 inches. A void space between the sheets (102) is filled with compressive concrete glue. An inner continuous tensile sheet undulates as a wall surface (103) which is a rigid structural shape. This assembly (101, 102 and 103) is a reinforced concrete structural component. The amount of undulation and the center to center repetition of the undulation may vary, however the sheet to sheet dimension, (101) to (103) can be set to remain constant. The sheet to sheet dimension can be set to half of the overall undulating wall depth, which can allow the tensile material to be placed into the neutral axis area of the wall. The surface tensile shape can then span the distance from the neutral axis of the wall to the surface which is either in tension or compression. In combination with the concrete glue, the undulating shape creates an efficient unitized integrated structural element. The design provides maximum structural stiffening and a composite structural action of the material assembly. The same benefits and relationships can occur when this assembly is used on any angle of rotation, i.e., including horizontally as a floor system.

Figure 1B:
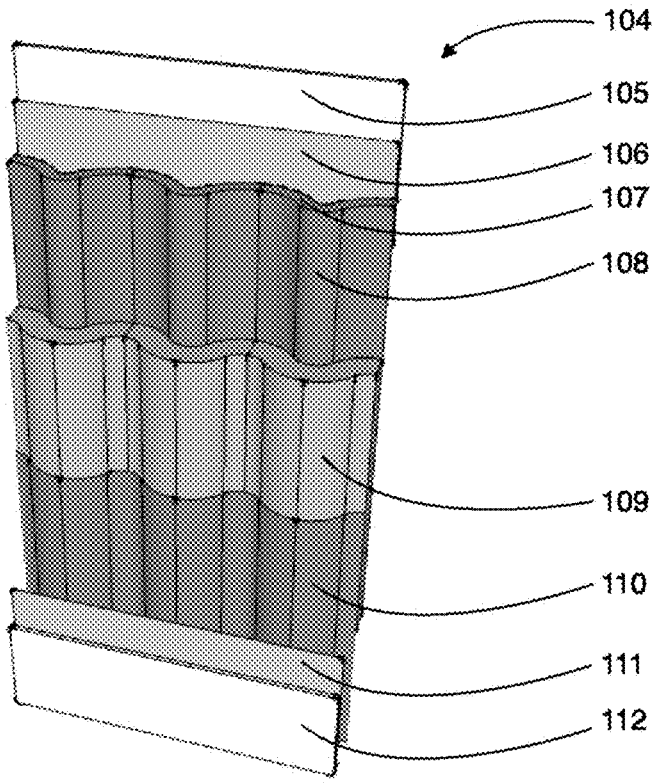
FIG. 1*b* is a perspective front view of the complete exterior insulating ribbon wall assembly, in accordance with some embodiments of the present disclosure.

FIG. 1*b* shows an insulated ribbon wall (104) that can include the following components (items are listed from the exterior side to the interior side): exterior sheathing (105), airspace, radiant foil (106), undulating airspace, spray foam (107), ribbon wall assembly (108, 109, 110), undulating airspace, radiant foil (111), airspace, interior sheathing (112). The undulation of the ribbon wall in combination with insulating materials can create dead airspaces, which can reduce heat transfer. Furthermore, the wall can have both thermal mass and a select variety of insulating materials which when placed in the stated order, reduces conductive, convective and radiant heat transfer.

In some examples, the wall can include electronics or electrical components. Such components can include wires and/or bus bars, computer systems (e.g., control systems), and energy storage devices (e.g., battery pack). The electronics can be dedicated for an individual module or for the module building.

Figure 2A:
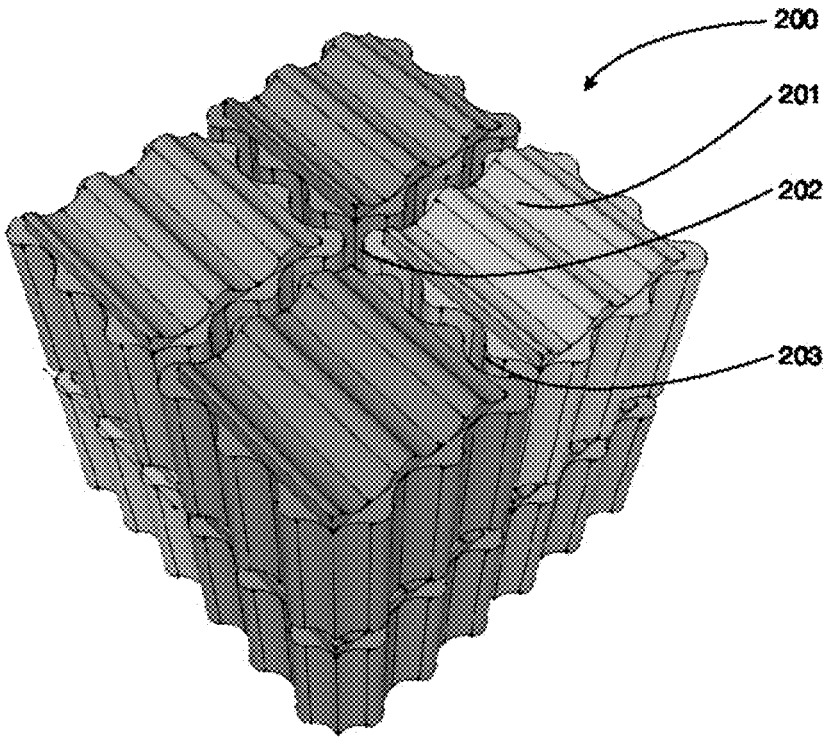
FIG. 2*a* is a perspective angle view of eight cellular ribbon wall blocks in their interlocking relationships, in accordance with some embodiments of the present disclosure.

With reference to FIG. 2*a*, ribbon walls can be created by the assembly of modular blocks (200). After the modular blocks are placed in a consistent interlocking relationship to one another, a binding agent (e.g., concrete glue) can be poured in the gap space between the modules. In some examples, the gap space is defined by the surfaces of the individual modules. An individual block (201) can be repeated vertically and horizontally to create the assembly (200). An interlocking ribbon wall (203) and interlocking intersection (202) are created by the consistent modular spacing and patterning.

Figure 2B:
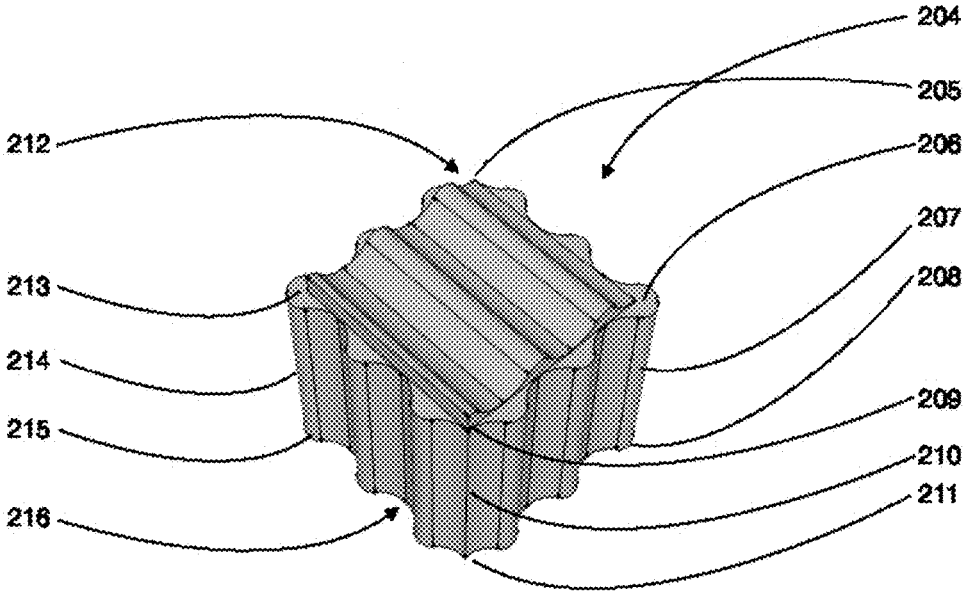
FIG. 2*b* is a perspective angle view of an individual cellular module with pattern layout, in accordance with some embodiments of the present disclosure.

All surfaces of the blocks can be patterned with the ribbon wall undulations described as follows. FIG. 2*b* shows a schematic perspective view of an individual block (204). The blocks can have male and female interlocking sections or portions. The corner (205) is female vertical (hidden) and female top. The corner (206) is male vertical a female top. The vertical edge (207) is male vertical. The corner (208) is male vertical and male bottom (hidden). The corner (209) is female vertical and male top. The vertical edge (210) is female vertical. The corner (211) is female vertical and female bottom (hidden). The rear vertical edge (hidden) (212) is female vertical and the rear bottom corner (hidden) (212) is female vertical and male bottom. The corner (213) is male vertical and male top. The vertical edge (214) is male vertical. The corner (215) is male vertical and female bottom (hidden). The bottom horizontal edge (hidden) (216) is female. In the illustrated example, the patterning is symmetrical and repetitive.

Figure 3A:
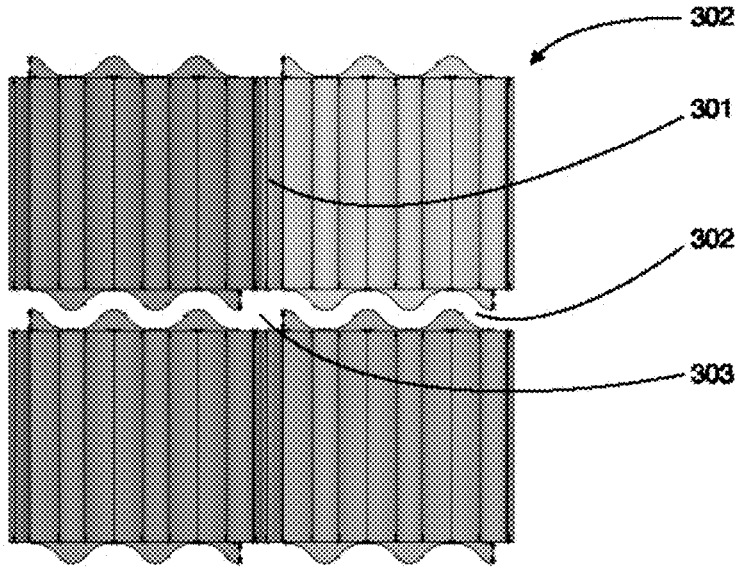
FIG. 3*a* is a front elevation view of four cellular ribbon wall blocks in their interlocking relationships, in accordance with some embodiments of the present disclosure.
Figure 3B:
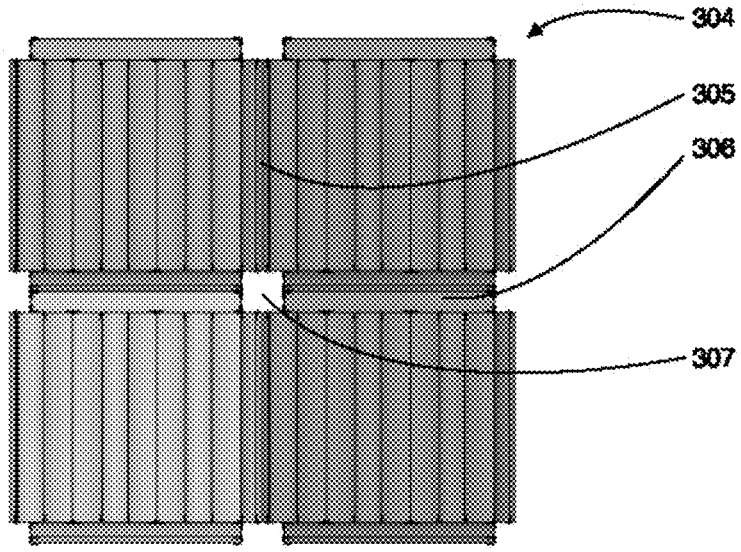
FIG. 3*b* is a side elevation view of four cellular ribbon wall blocks in their interlocking relationships, in accordance with some embodiments of the present disclosure.

FIG. 3*a* is a schematic side elevation view of four modular blocks (300). The vertical ribbon wall (301) and horizontal (302) ribbon wall or "floor" intersect at a beam void (303). FIG. 3*b* is a schematic side elevation view of four modular blocks (304). The side elevation view of four modular blocks (304) is rotated 90 degrees from FIG. 3*a*. The vertical ribbon wall (305) and horizontal (306) ribbon wall or "floor" intersects at a beam void (307). When the void spaces are poured and filled with a binding agent (e.g., concrete glue), a reinforced composite wall and beam structure is created.

Figure 4A:
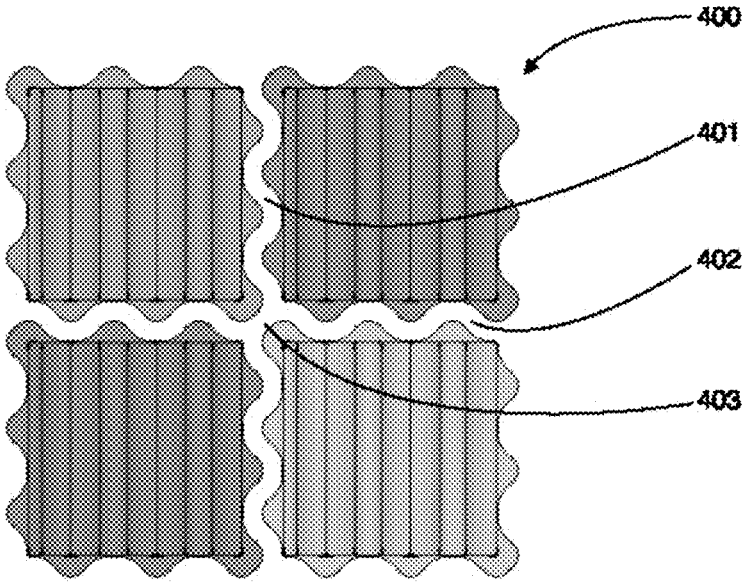
FIG. 4*a* is a top elevation view of four cellular ribbon wall blocks in their interlocking relationships, in accordance with some embodiments of the present disclosure.
Figure 4B:
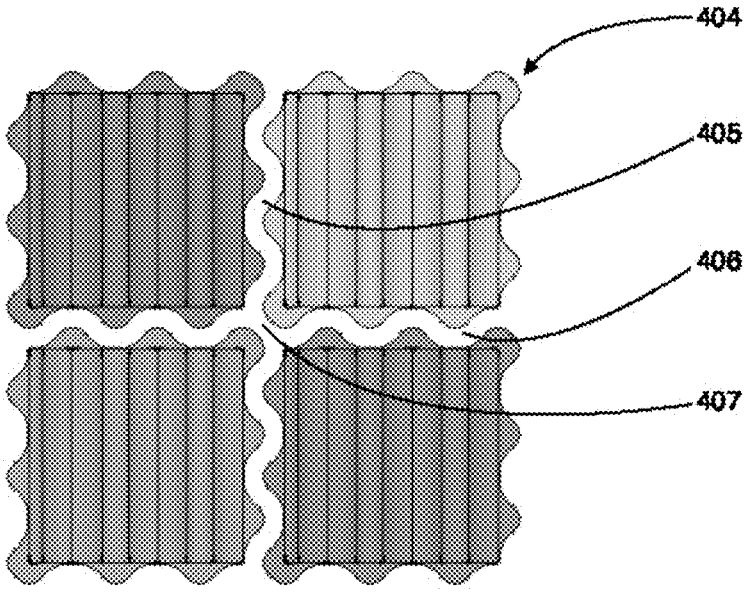
FIG. 4*b* is a bottom elevation view of four cellular ribbon wall blocks in their interlocking relationships, in accordance with some embodiments of the present disclosure.

FIG. 4*a* shows a top plane view of four modular blocks (400). The ribbon wall (401) and perpendicular ribbon wall (402) meet at a four-way ribbon wall intersection (403). FIG. 4*b* shows a bottom plan view of four modular blocks (404). The ribbon wall (405) and perpendicular ribbon wall (406) meet at a four-way ribbon wall intersection (407). When the void spaces are poured and filled with a binding agent (e.g., concrete glue), a reinforced composite wall and beam structure is created.

Figure 5A:
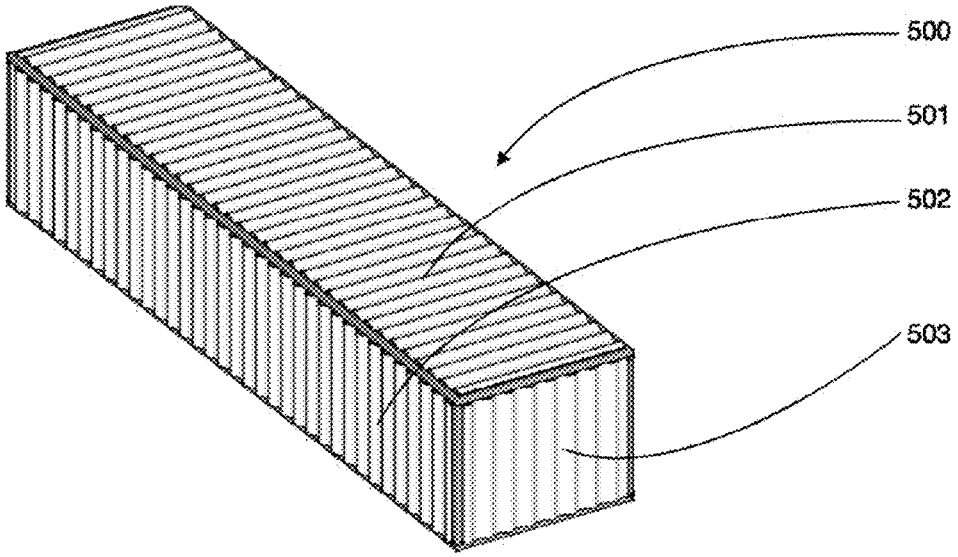
FIG. 5*a* is a perspective angle view a full size module, in accordance with some embodiments of the present disclosure.
Figure 5B:
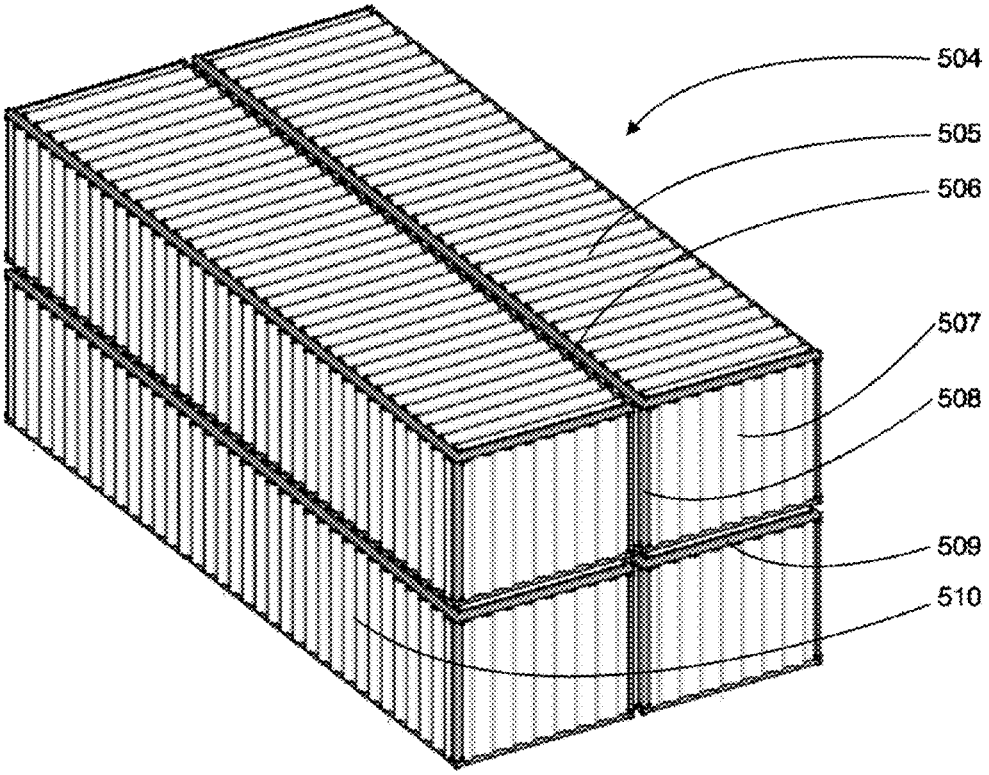
FIG. 5*b* is a perspective angle view of four full size modules, in accordance with some embodiments of the present disclosure.

FIGS. 5*a* and 5*b* show modular building units. FIG. 5*a* shows a perspective top-down view of a habitable modular building unit (500). The shape and size of the unit (500) can be selected such that the unit (500) is habitable (e.g., habitable by a human). In an example, the unit (500) is from 9' to 12' in height, 8' to 16' in width, and up to 60' in length. Sizes in this range can be capable of being trucked to a building site. For example, the unit (500) can be set up at a first location and rolled onto a flatbed truck that can transport the unit (500) to a remote second location. At the second location, the unit (500) can be rolled off of the truck. As an alternative, the unit (500) can be placed on and removed from the truck (or other mechanical device) using a lifting device, such as, for example, a crane.

With continue reference to FIG. 5*a*, the top (501), side (502) and the front (503) of the unit (500) are shown with the ribbon wall undulations for a 8" wide ribbon wall and a 4" separation void which can be filled with a binding agent, such as, for example, concrete glue. FIG. 5*b* is a perspective top-down view of a building unit (504) comprising four modular blocks. The shape and size of the blocks can be selected such that the blocks and the unit (504) are habitable (e.g., habitable by a human). The top (505), the vertical ribbon wall (506), the front (507), the vertical ribbon wall (508), the horizontal ribbon wall (509), "floor", and the side (510) are shown with the ribbon wall undulations for a 8" wide ribbon wall and a 4" separation void which will be filled with concrete glue. These dimensions may vary. The interlocking geometric relationships are shown in a scaled module which can be appropriately sized for human habitation.

Figure 6A:
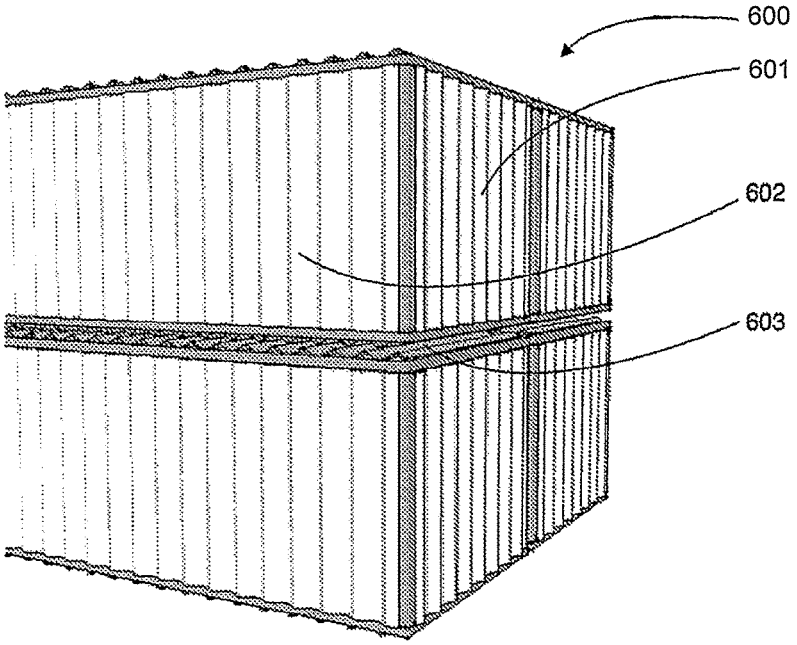
FIG. 6*a* is a perspective detail angle view of four full size modules showing geometric floor alignment, in accordance with some embodiments of the present disclosure.
Figure 6B:
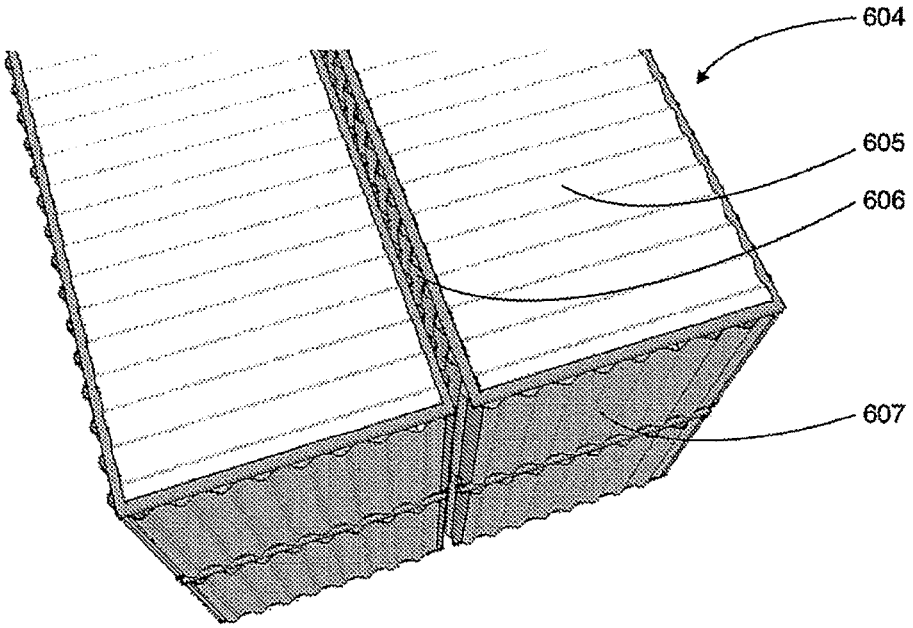
FIG. 6*b* is a perspective detail angle view of four full size modules showing geometric wall alignment, in accordance with some embodiments of the present disclosure.

FIG. 6*a* shows an angle view of four modular blocks with shape and size for use as a habitable modular building unit (600). The end (601) and side (602), and the view of FIG. 6*a*, show the continuous alignment of the horizontal ribbon wall (603), which may be a floor. FIG. 6*b* is a top angle view of a unit (604) comprising four blocks. An end (607) and top (605) of the unit (604) shows the continuous alignment of a vertical ribbon wall (606) of the unit (604).

Figure 7:
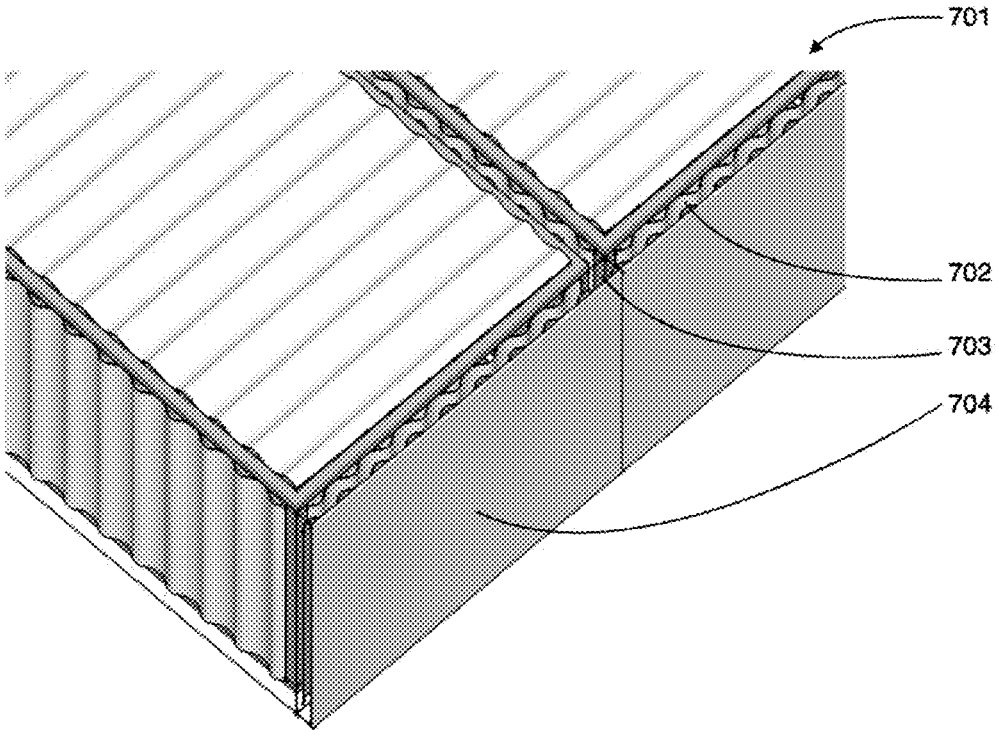
FIG. 7 is a perspective detail angle view of two full size modules with exterior panels attached, in accordance with some embodiments of the present disclosure.

FIG. 7 is an angle view of two modular blocks with shape and size for use as a habitable modular building unit. Each of the blocks of the unit comprises a ribbon wall (701), a ribbon wall intersection (702) and exterior sheathing (703). The assembly of the exterior panel is as described elsewhere herein, such as in the context of FIG. 1*b*.

Figure 8:
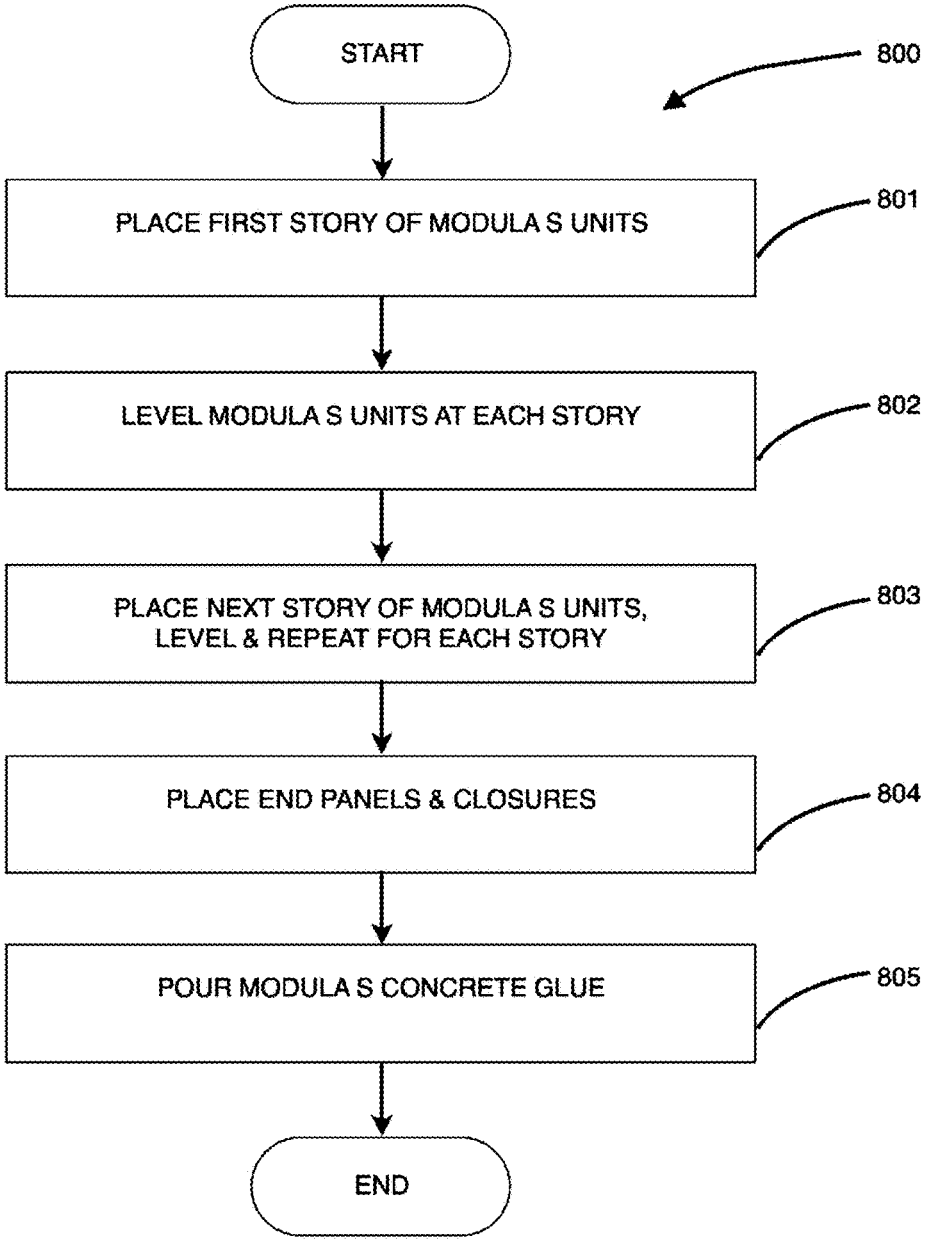
FIG. 8 schematically illustrates a method for forming a building, in accordance with some embodiments of the present disclosure.

FIG. 8 schematically illustrates a method for forming a modular building unit. The overall process (800) is comprised of a series of non-limiting operations 801, 802, 803, 804 and 805, which can utilize the multi-use modular block as a waterproof shipping container, as a structural component, and as a concrete form where the concrete is poured as the last step in the process. This creates a composite reinforced structure.

In a first operation 801 of the method 800, a first story of the building is provided on a support structure, such as, for example, a wooden or concrete slab. In a second operation 802, the units at each story are leveled. Next, in a third operation 803, another story is placed on top of the first story and leveled. This can be repeated for additional stories. In a fourth operation 804, end panels and closure are then provided. Next, in a fifth operation, a binding agent (e.g., concrete) is poured. The binding agent can fill the gaps (or voids) between the stories and the individual modules in each story. In some examples, the binding agent can then be dried (e.g., heat dried, air dried) to harden. Each story of the building can be tethered to the support structure or the ground.

The process 800 can be used to construct a building with at least 1, 2, 3, 4, 5, 6, 7, 8, 9, 10, 20, 30, 40, 50, 60, 70, 80, 90, or 100 stories. Each story can include at least 1, 2, 3, 4, 5, 6, 7, 8, 9, 10, 20, 30, 40, 50, 60, 70, 80, 90, or 100 modules (see, e.g., FIG. 5*a* for an individual module).

In some examples, the modules are the steel reinforcement of a concrete building. This can provide a composite structural system.

In another aspect, a building structure comprises modules. The modules can be interlocking modules. The building modules can be adjacent to one another, such as in a side-by-side configuration, stacked configuration, or a combination thereof. Each of the modules can comprise wall panels. The wall panels can be as described elsewhere herein. In some examples, the wall panels include electronic components. A module can include a core structural support member, such as, for example, a core support member formed of an organic material (e.g., wood), metallic material (e.g., steel), or combination thereof. In an example, a module includes a core formed of steel.

The modules may be formed of a metallic material, organic material (e.g., wood) composite material (e.g., carbon fiber), polymeric material, or a combination thereof. The modules may be single-use or reusable.

In some embodiments, concrete is used for fireproofing, soundproofing, thermal mass and/or blast (or other external/internal force) protection. In some cases, a binding agent (e.g., concrete) is precluded. As an alternative, a binding agent can be used, which may be releasable from the modules.

The modules can have lift points or rollers, which can enable the modules to be lifted or rolled into a given position. The lift points can be industry standard lift points. Additional lift points can be added so that the modules can be fastened is any interlocking direction.

In some examples, a wall of a given module bears all or substantially all of the structural load and can commonly be stacked 1, 2, 3, 4, 5, 6, 7, 8, 9, 10, 11, 12, 13, 14, 15, 16, 17, 18, 19, 20, or more units high.

At least a subset of the modules can communicate with one another through a communications bus. At least a subset of the modules can be electrically coupled to one another through an electrical bus. The modules can share resources, such as, for example, electrical energy.

Figure 9A:
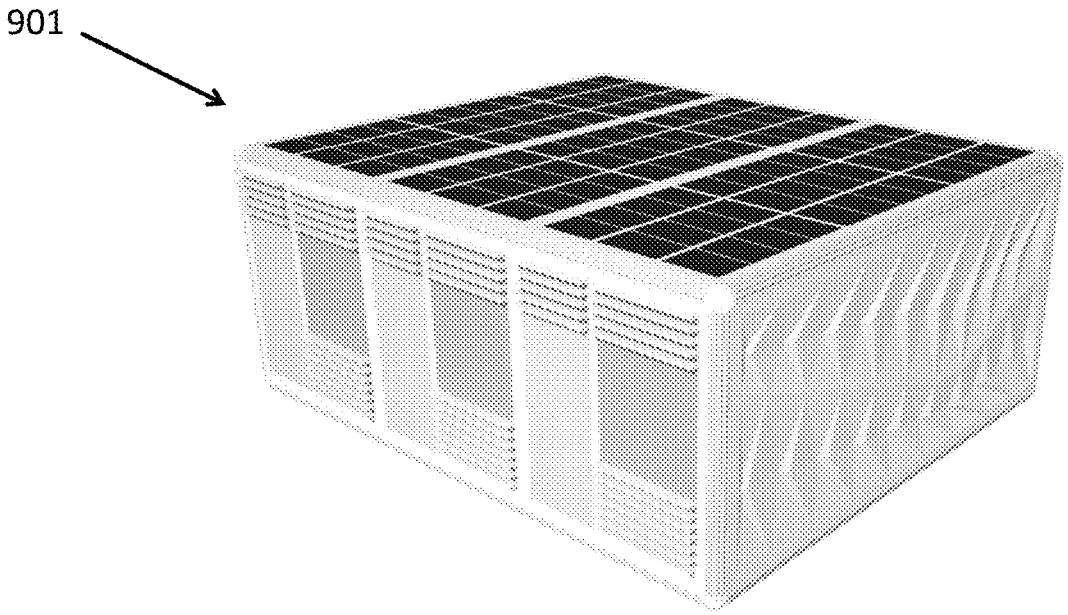
FIGS. 9*a* and 9*b* are perspective side views of a building module, in accordance with some embodiments of the present disclosure.
Figure 9B:
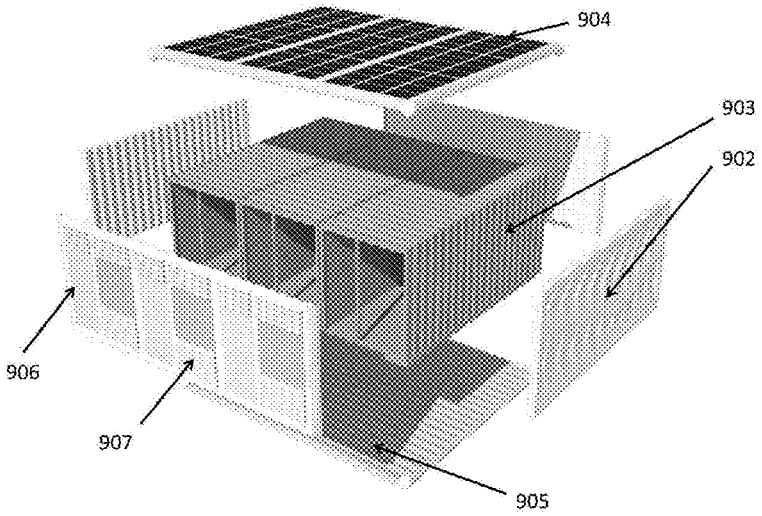

FIGS. 9*a* and 9*b* are perspective side views of a building module (901). FIG. 9*b* is an exploded view of the module of FIG. 9*a*. The building module in the illustrated examples, comprises six walls (or panels) (902) and a central support structure that is hollow (903). A top wall comprises PV cells (904) for providing power upon exposure to electromagnetic radiation. The top wall can be formed of carbon fiber or other composite material. A subset of the walls comprises ribbon walls. The walls of the module of FIGS. 9*a* and 9*b* can be assembled in a snap-on manner. A floor panel (905) can be a super-insulated floor panel (906). A side panel (906) can include ventilation holes, slots, or passages (907)

The walls of the module can be formed of various materials. The walls of the module can be formed of a metallic insulating or composite material. In an example, the walls are formed of carbon fiber material. In another example, the walls are formed or aluminum or steel. Some or all of the walls can contain active technologies.

The walls of the module of FIGS. 9*a* and 9*b* can be interchangeable panels. A user may select a panel that is best suited for a given extreme environment. For instance, a panel can be selected to provide air flow in situations in which there is extreme heat (e.g., desert conditions).

Modules can be interlocking. Each module can receive and integrate advanced energy and technology systems, such as, for example, energy storage systems, energy harvesting systems (e.g., PV modules), and heating and/or cooling systems.

Some or all of the walls of the module can be insulated. A wall can include ventilation for fluid (e.g., air) flow. In some situations, at least a subset of the walls of the module can include a heat exchanger.

Some or all of the walls of the module can be fireproof. In some examples, the walls of the module include releasable concrete in all panel/box ribbon wall cavities, which may provide for fireproof and/or blast protection. The wall cavities can include other material for blast protection, such as metallic (e.g., steel) slabs.

Figure 10A:
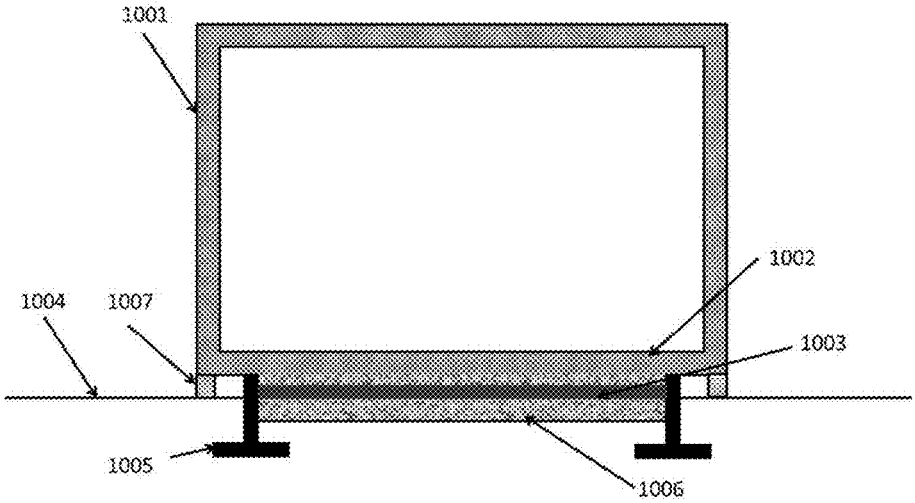
FIGS. 10*a* and 10*b* show a building structure comprising a building module, in accordance with some embodiments of the present disclosure.

FIG. 10*a* shows a cross section view of a single building module 1001 with a bottom portion of the building structure configured for ground source heating and/or cooling with the use of a ground source geothermal heat pump. The bottom portion can include thermal insulation or a super-insulated floor panel 1002, the panel shown in this case is 6" thick, and a heat exchanger 1003 to enable the exchange of thermal energy with the ground. The floor panel can be elevated from the ground surface 1004 by pedestal stilts 1005. The space created by the stilts between the floor panel and the earth is filled with a soil blend 1006 optimized with non-toxic materials and moisture content to increase heat transfer between the ground and the heat exchanger tubing, in an example, a soil layer of 8" depth is used. Super-insulated perimeter panels 1007 can be placed along the perimeter of the ground panel to further insulate the module.

Figure 10B:
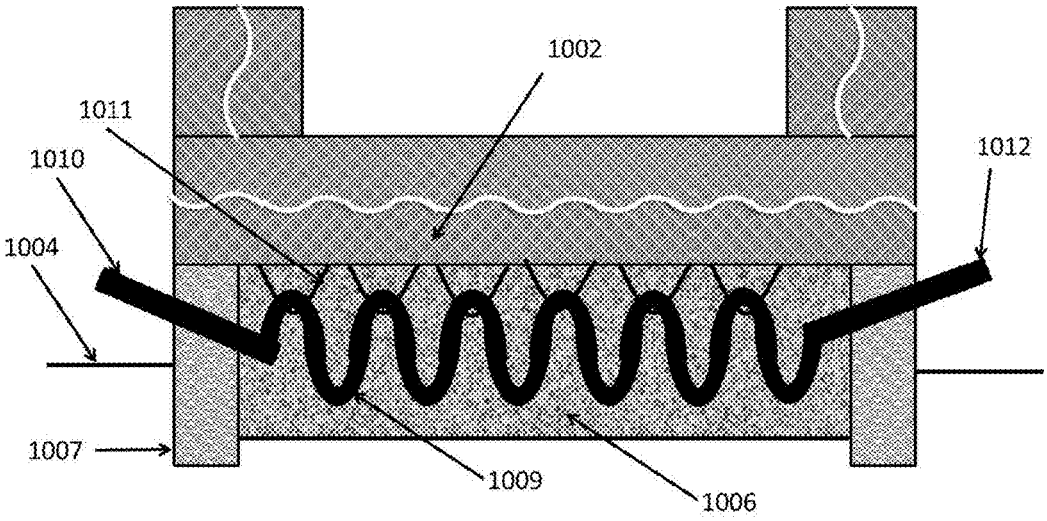

FIG. 10*b* shows a detailed view of the bottom region of FIG. 10*a*. The bottom super-insulated panel 1002 is shown. Underneath the panel 1002 is a blend of soil 1006 designed for superior heat transfer to the heat exchanger tubing, here depicted as a coil 1009. The soil 1006, in some examples can include clay, iron, and high moisture compost materials. The heat exchanger tubing is held in place by supports 1010 attached to the bottom panel. An inlet 1011 and outlet 1012 for the heat exchanger working fluid are shown. The inlet 1011 and outlet 1012 for the heat exchanger may be connected to a pump inside or outside of the module 1001. The coil loop and pump can be part of a circulation fluid flow cycle.

In an example, a building module comprises a super-insulated ground floor panel. An example of a super-insulated ground floor panel can be the insulated ribbon wall described by FIG. 1*b*. The super-insulated panel can act as a damn and trap thermal energy from leaving the surface of the ground. In such a case, ground-source temperature can rise to the building and be employed for use in geothermal heating and/or cooling applications. This may be employed with a PV panel (see, e.g., FIGS. 9*a* and 9*b*). One unit of solar electric may provide at least two, three, or four units of heating or cooling when used as the power source for the geothermal heat pump.

The modules and structures of FIG. 10 can have features described elsewhere herein, such as, for example, those described in the context of FIGS. 1-8 above.

Modules of the present disclosure can have various uses. Modules can be used as office space, habitable space, and protective purposes, for example.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A building structure, comprising:

a plurality of modules, wherein an individual module among the plurality comprises a plurality of wall panels, wherein each of the plurality of wall panels comprises a curved outer surface having a pattern of peaks and valleys that conforms to a pattern of peaks and valleys of a curved outer surface of an adjacent module of the plurality of modules, wherein the peaks conform to the valleys, and wherein the peaks extend to a neutral axis between the individual module and the adjacent module; and a binding agent in one or more void spaces between the plurality of modules, wherein the binding agent fixes and maintains the plurality of modules in proximity to one another, wherein the plurality of wall panels comprises a first wall panel and a second wall panel, wherein the first wall panel comprises a photovoltaic (PV) module and the second wall panel comprises an energy storage system that is in electrical communication with the PV module, and wherein the plurality of wall panels comprises a third wall panel that comprises a heat exchanger.

2. The building structure of claim 1, further comprising electronic systems, wherein the electronic systems of the plurality of modules are in electronic communication with one another.

3. The building structure of claim 1, wherein the individual module is transportable by a truck to a building site, and wherein the binding agent is a chemical binding agent.

4. The building structure of claim 1, wherein at least some of the plurality of modules have a core structural support member.

5. The building structure of claim 1, wherein at least some of the wall panels are snap on panels, and wherein at least some of the wall panels are fire proof.

6. The building structure of claim 1, wherein the plurality of wall panels contain material selected from the group consisting of fiberglass, cellulose, polystyrene, polyurethane foam, and mineral wool.

7. The building structure of claim 1, wherein a curved outer surface of a given module of the plurality of modules is capable of interlocking with a curved outer surface of another module of the plurality of modules.

8. A building structure, comprising:

a plurality of modules, wherein an individual module among the plurality comprises a plurality of wall panels, wherein each of the plurality of wall panels comprises a curved outer surface having a pattern of peaks and valleys that conforms to a pattern of peaks and valleys of a curved outer surface of an adjacent module of the plurality of modules, wherein the peaks conform to the valleys, and wherein the peaks extend to a neutral axis between the individual module and the adjacent module; and a binding agent in one or more void spaces between the plurality of modules, wherein the binding agent fixes and maintains the plurality of modules in proximity to one another, wherein the plurality of wall panels includes an insulated bottom panel, and wherein the bottom panel comprises two curved outer sheets with foil, insulation, and dead air space between the sheets.

9. The building structure of claim 8, further comprising electronic systems, wherein the electronic systems of the plurality of modules are in electronic communication with one another.

10. The building structure of claim 8, wherein the individual module is transportable by a truck to a building site, and wherein the binding agent is a chemical binding agent.

11. The building structure of claim 8, wherein at least some of the plurality of modules have a core structural support member.

12. The building structure of claim 8, wherein at least some of the wall panels are snap on panels, and wherein at least some of the wall panels are fire proof.

13. The building structure of claim 8, wherein the plurality of wall panels comprises a first wall panel and a second wall panel, wherein the first wall panel comprises a photovoltaic (PV) module and the second wall panel comprises an energy storage system that is in electrical communication with the PV module.

14. The building structure of claim 13, wherein the plurality of wall panels comprises a third wall panel that comprises a heat exchanger.

15. The building structure of claim 8, wherein the plurality of wall panels contain material selected from the group consisting of fiberglass, cellulose, polystyrene, polyurethane foam, and mineral wool.

16. The building structure of claim 8, wherein a curved outer surface of a given module of the plurality of modules is capable of interlocking with a curved outer surface of another module of the plurality of modules.

17. A building structure, comprising:

a plurality of modules, wherein an individual module among the plurality comprises a plurality of wall panels, wherein each of the plurality of wall panels comprises a curved outer surface having a pattern of peaks and valleys that conforms to a pattern of peaks and valleys of a curved outer surface of an adjacent module of the plurality of modules, wherein the peaks conform to the valleys, and wherein the peaks extend to a neutral axis between the individual module and the adjacent module; and a binding agent in one or more void spaces between the plurality of modules, wherein the binding agent fixes and maintains the plurality of modules in proximity to one another, wherein the plurality of wall panels includes an insulated bottom panel, and wherein the bottom panel traps thermal energy.

18. The building structure of claim 17, wherein at least some of the wall panels are snap on panels, and wherein at least some of the wall panels are fire proof.

19. The building structure of claim 17, wherein the bottom panel comprises two curved outer sheets with foil, insulation, and dead air space between the sheets.

20. The building structure of claim 17, wherein a curved outer surface of a given module of the plurality of modules is capable of interlocking with a curved outer surface of another module of the plurality of modules.

* * * * *